US010233752B2

(12) United States Patent
Chiang

(10) Patent No.: US 10,233,752 B2
(45) Date of Patent: Mar. 19, 2019

(54) CUTTING TOOL HOLDING MECHANISM

(71) Applicant: EVERPADS CO., LTD., Taichung (TW)

(72) Inventor: Chun-Li Chiang, Taichung (TW)

(73) Assignee: EVERPADS CO., LTD., Taichung (TW)

( * ) Notice: Subject to any disclaimer, the term of this patent is extended or adjusted under 35 U.S.C. 154(b) by 67 days.

(21) Appl. No.: 15/582,751

(22) Filed: Apr. 30, 2017

(65) Prior Publication Data

US 2017/0342832 A1 Nov. 30, 2017

(30) Foreign Application Priority Data

May 31, 2016 (TW) ..... 105208136 U

(51) Int. Cl.

| | |
|---|---|
| ***E21C 35/18*** | (2006.01) |
| ***E21C 35/193*** | (2006.01) |
| ***E01C 23/088*** | (2006.01) |
| ***E01C 23/12*** | (2006.01) |
| *E21C 35/19* | (2006.01) |

(52) U.S. Cl.
CPC ..... *E21C 35/1933* (2013.01); *E01C 23/088* (2013.01); *E01C 23/127* (2013.01); *E21C 2035/191* (2013.01)

(58) Field of Classification Search
CPC ..... E21C 35/193–35/1936
See application file for complete search history.

(56) References Cited

U.S. PATENT DOCUMENTS 3,801,158 A * 4/1974 Radd ..... E21C 35/1933 175/334
3,942,838 A * 3/1976 Bailey ..... B25D 17/02 299/113

FOREIGN PATENT DOCUMENTS

DE 2032472 A1 * 1/1971 ..... E21C 35/1936
DE 2538648 A1 * 3/1977 ..... E21C 27/44
EP 0771911 A1 * 5/1997 ..... B28D 1/188

* cited by examiner

*Primary Examiner* — Janine M Kreck
(74) *Attorney, Agent, or Firm* — CKC & Partners Co., LLC

(57) ABSTRACT

A cutting tool holding mechanism includes a base, a handle and a locking assembly. The base includes an abutting portion, a receiving bore, at least one limiting bore and at least one limiting hole. The limiting hole is disposed at the base and communicated with the limiting bore. The handle abutted against the base includes a sleeved portion and a plurality of positioning surfaces. The locking assembly includes a packing ring, a locking screw, a locking member and a guiding bolt. The locking member received inside the limiting bore includes a screwed hole and a guiding groove. The guiding groove disposed at one side of the locking member and is aligned with the limiting hole when the locking member is disposed inside the limiting bore. The guiding bolt is disposed in the limiting hole and is abutted against the guiding groove to inhibit the locking member from rotating.

19 Claims, 8 Drawing Sheets

CUTTING TOOL HOLDING MECHANISM

RELATED APPLICATIONS

This application claims priority to Taiwan Application Serial Number 105208136, filed May 31, 2016, which is herein incorporated by reference.

BACKGROUND

Technical Field

The present disclosure relates to a cutting tool holding mechanism. More particularly, the present disclosure relates to a cutting tool holding mechanism applied to a road milling machine.

Description of Related Art

A cutting tool holding mechanism is a device which is disposed at a road milling machine for holding the cutting tool. The cutting tool will receive a huge impact due to the high resistance occurred in construction, and the cutting tool will be damaged even if it is made of the toughness material.

Owing to the bad working environment, there is a need to develop a cutting tool holding mechanism which can firmly secure the cutting tool onto the road milling machine. Moreover, because the lift time of the cutting tool is short, the cutting tool holding mechanism must be able to be assembled and separated quickly to change the cutting tool.

In order to provide enough clamping force and convenient assembling ability, the prior cutting tool holding mechanism includes a base and a clamping portion. The handle is passed through the base and the clamping portion to be installed in the cutting tool holding mechanism. The clamping portion and the base are fastened by screws or wedges, and the cutting tool is secured by the base and the clamping portion.

However, in order to assemble the handle, the clamping portion and the base together, the shapes of the handle, the clamping portion and the base must be coordinated accurately; consequently, the design of the modes is complex. Moreover, the mechanical strength is lower when the cutting tool holding mechanism is made by several components.

The reaction force applied on the cutting tool is parallel to a central axis of the cutting tool, that is, the force applied along the vertical direction; accordingly, the connecting surface between the base and the clamping portion is parallel to a horizontal direction which is perpendicular to the central axis of the cutting tool in order to provide enough supporting force.

A milling machine will include a plurality of cutting tool holding mechanisms disposed at a milling drum. For the prior cutting tool holding mechanism, the screws are inserted into the cutting tool holding mechanism along the horizontal direction, and the separating operation of the cutting tool holding mechanism will be affected by other cutting tool holding mechanisms. As a result, the cutting tool is not easily to be changed.

Therefore, although the cutting tool holding mechanism has enough clamping force, it still has the disadvantage of high manufacturing cost. Furthermore, it spends much time and money to change the cutting tool.

SUMMARY

A cutting tool holding mechanism includes a base, a handle and a locking assembly. The base includes an abutting portion, a receiving bore, at least one limiting bore and at least one limiting hole. The abutting portion includes a plurality of abutting surfaces. The receiving bore is depressively disposed in the base. The limiting bore is depressively disposed in the base and communicated with the receiving bore. The limiting hole is disposed at the base and communicated with the limiting bore. The handle abutted against the base includes a sleeved portion and a plurality of positioning surfaces. The sleeved portion disposed inside the receiving bore includes at least one butting portion, wherein the butting portion is located at an intersection of the receiving bore and the limiting bore when the sleeved portion is disposed inside the receiving bore. A number of the positioning surfaces is corresponding to a number of the abutting surfaces such that the handle can be positioned on the base. The locking assembly includes a packing ring, a locking screw, a locking member and a guiding bolt. The packing ring includes a through hole. The locking screw includes a head portion and a screwing portion. The head portion is abutted against the packing ring. The screwing portion is passed through the through hole to protrude into the limiting bore. The locking member received inside the limiting bore includes a screwed hole and a guiding groove. The screwed hole is for securing the screwing portion. The guiding groove disposed at one side of the locking member and is aligned with the limiting hole when the locking member is disposed inside the limiting bore. An extending direction of the guiding groove is parallel to a central axis of the limiting bore. The guiding bolt is disposed in the limiting hole and is abutted against the guiding groove to inhibit the locking member from rotating. The locking member is for moving along the central axis to push against the butting portion.

A cutting tool holding mechanism includes a base, a handle and at least one locking assembly. The base includes a receiving bore, at least one receiving bore, and at least one limiting hole. The receiving bore is depressively disposed in the base. The limiting bore is depressively disposed in the base and communicated with the receiving bore. An angle contained between the limiting bore and a virtual horizontal-surface is smaller than 180 degrees. The limiting hole is disposed at the base and is communicated with the limiting bore. The handle abutted against the base includes a sleeved portion. The sleeved portion disposed in the receiving bore includes at least one butting portion, wherein the butting portion is located at an intersection of the receiving bore and the limiting bore when the sleeved portion is disposed inside the receiving bore. The locking assembly includes a locking screw, a locking member and a guiding bolt. The locking screw includes a head portion and a screwing portion. The screwing portion is protruded into the limiting bore. The locking member received inside the limiting bore includes a screwed hole and a guiding groove. The screwed hole is for securing the screwing portion. The guiding groove is disposed at one side of the locking member and is aligned with the limiting hole when the locking member is disposed inside the limiting bore. An extending direction of the guiding groove is parallel to a central axis of the limiting bore. The guiding bolt is disposed in the limiting hole and is abutted against the guiding groove to inhibit the locking member from rotating. The locking member is for moving along the central axis to push against the butting portion.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
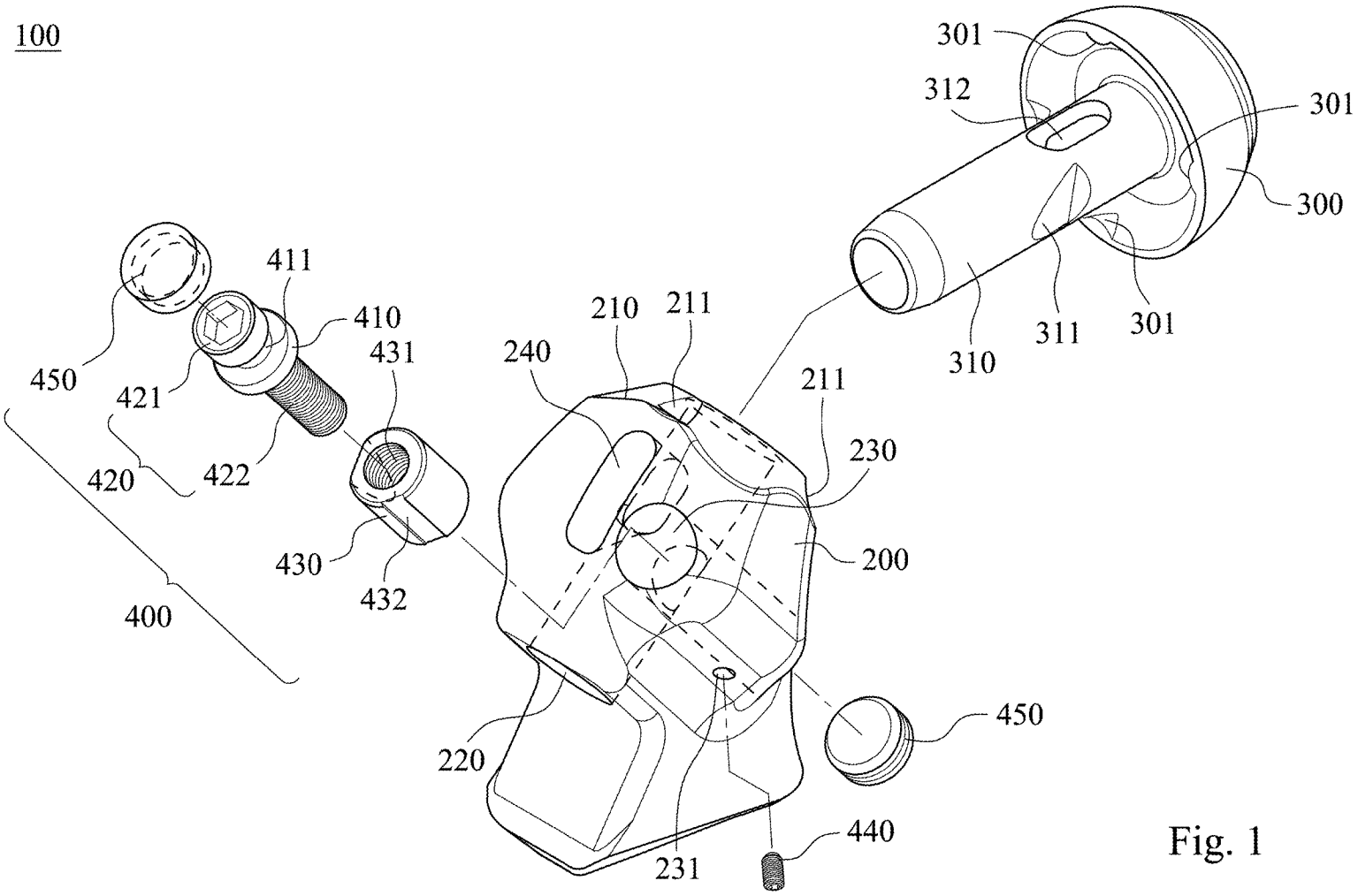
FIG. 1 shows an exploded view of a cutting tool holding mechanism according to one embodiment of the present disclosure.
Figure 2:
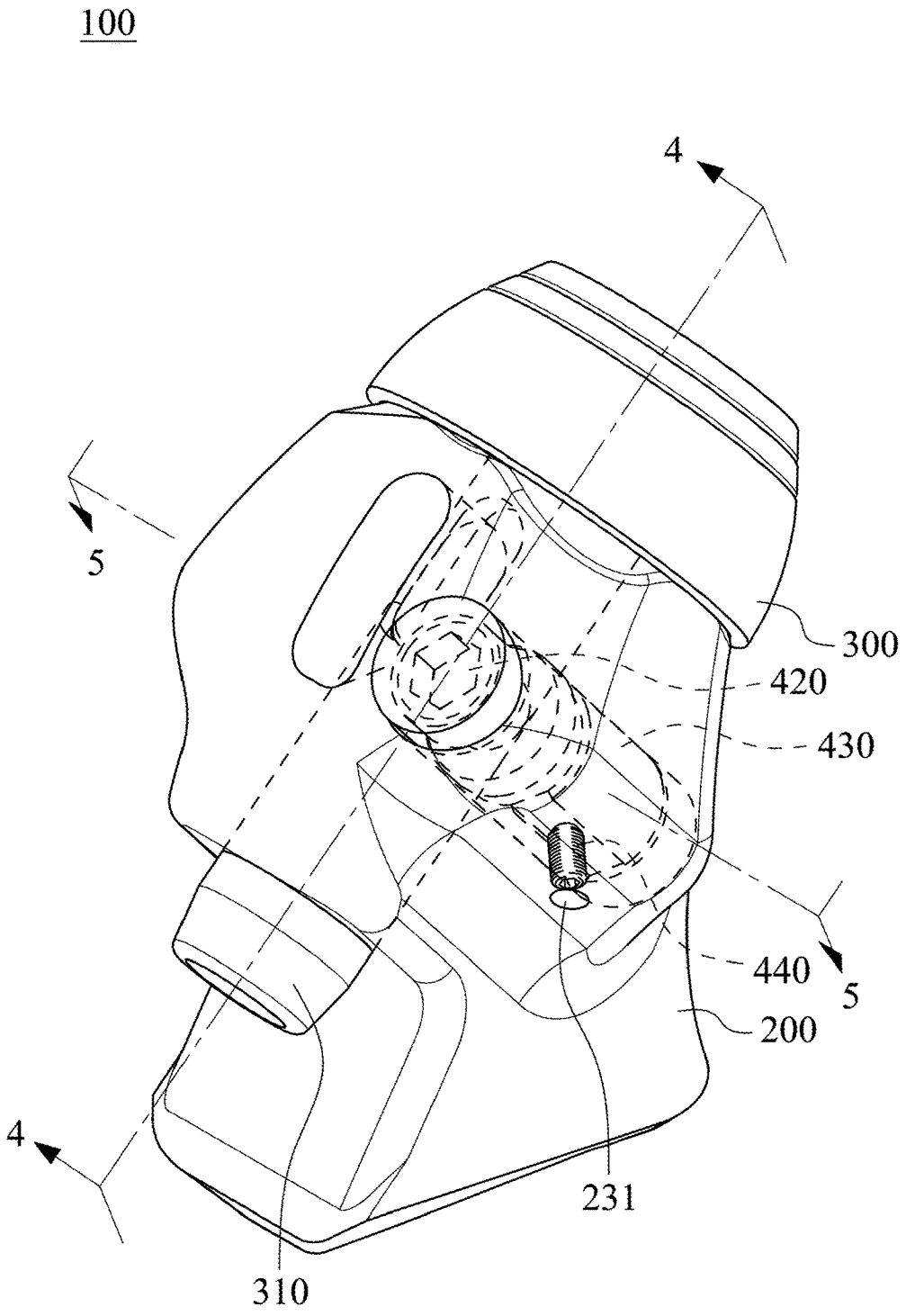
FIG. 2 shows a schematic view of a combination state of the cutting tool holding mechanism of FIG. 1.

Please refer to FIG. 1 and FIG. 2. FIG. 1 shows an exploded view of a cutting tool holding mechanism 100 according to one embodiment of the present disclosure. FIG. 2 shows a schematic view of a combination state of the cutting tool holding mechanism 100 of FIG. 1. The cutting tool holding mechanism 100 includes a base 200, a handle 300 and a locking assembly 400. The base 200 includes an abutting portion 210, a receiving bore 220 and a limiting bore 230. The abutting portion 210 includes a plurality of abutting surfaces 211, and a number of the abutting surfaces 211 and a position and a shape of each of abutting surfaces 211 are not limited thereto. The receiving bore 220 depressively disposed at the base 200. The limiting bore 230 is disposed at one side of the receiving bore 220 and is communicated with the receiving bore 220. A limiting hole 231 is disposed at the base 200 to correspond to the limiting bore 230.

The handle 300 is abutted against the base 200. The handle 300 includes a sleeved portion 310 and a plurality of positioning surfaces 301. The sleeved portion 310 is received inside the receiving bore 220. The number of the positioning surfaces 301 is corresponding to the number of the abutting surfaces 211, and the shapes of the positioning surfaces 301 are corresponding to the shapes of the abutting surfaces 211. Accordingly, the positioning surfaces 301 can provide positioning function to position the handle 300 on the base 200 when the sleeved portion 310 is inserted into the receiving bore 220. In the embodiment, the abutting surfaces 211 are annularly distributed at the base 200 to surround an opening of the receiving bore 220; thus, the handle 300 which is inserted into the receiving bore 220 can be auto-centering. Besides, the base 200 includes a pin hole 240, and the sleeved portion 310 includes an anchor hole 312 corresponding to the pin hole 240. When the handle 300 is abutted against the base 200, a pin (not shown) can be inserted into the pin hole 240 and the anchor hole 312 to secure the handle 300.

Figure 4:
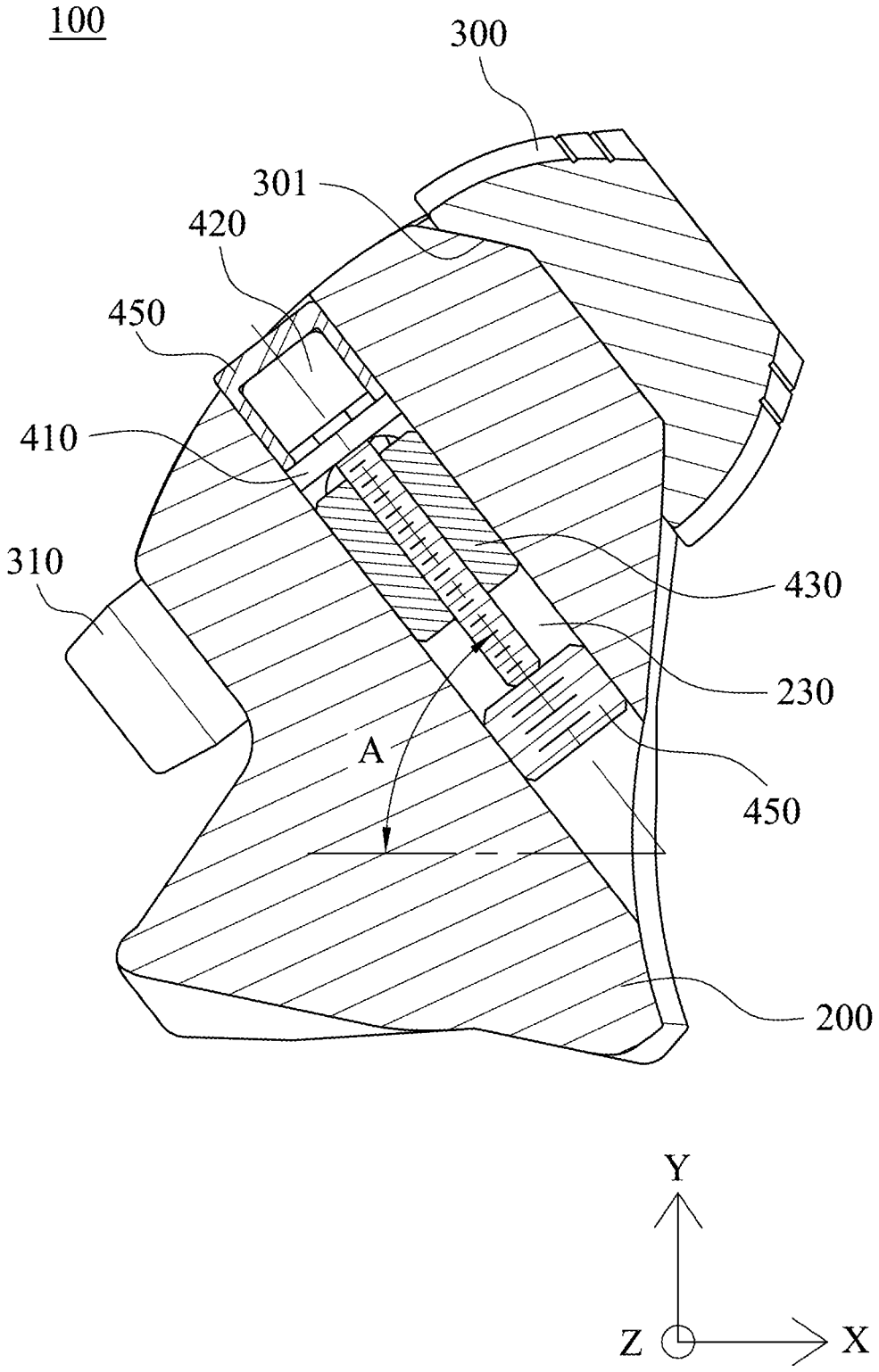
FIG. 4 shows a cross-sectional view of the cutting tool holding mechanism taken along line 4-4 of FIG. 2.
Figure 5:
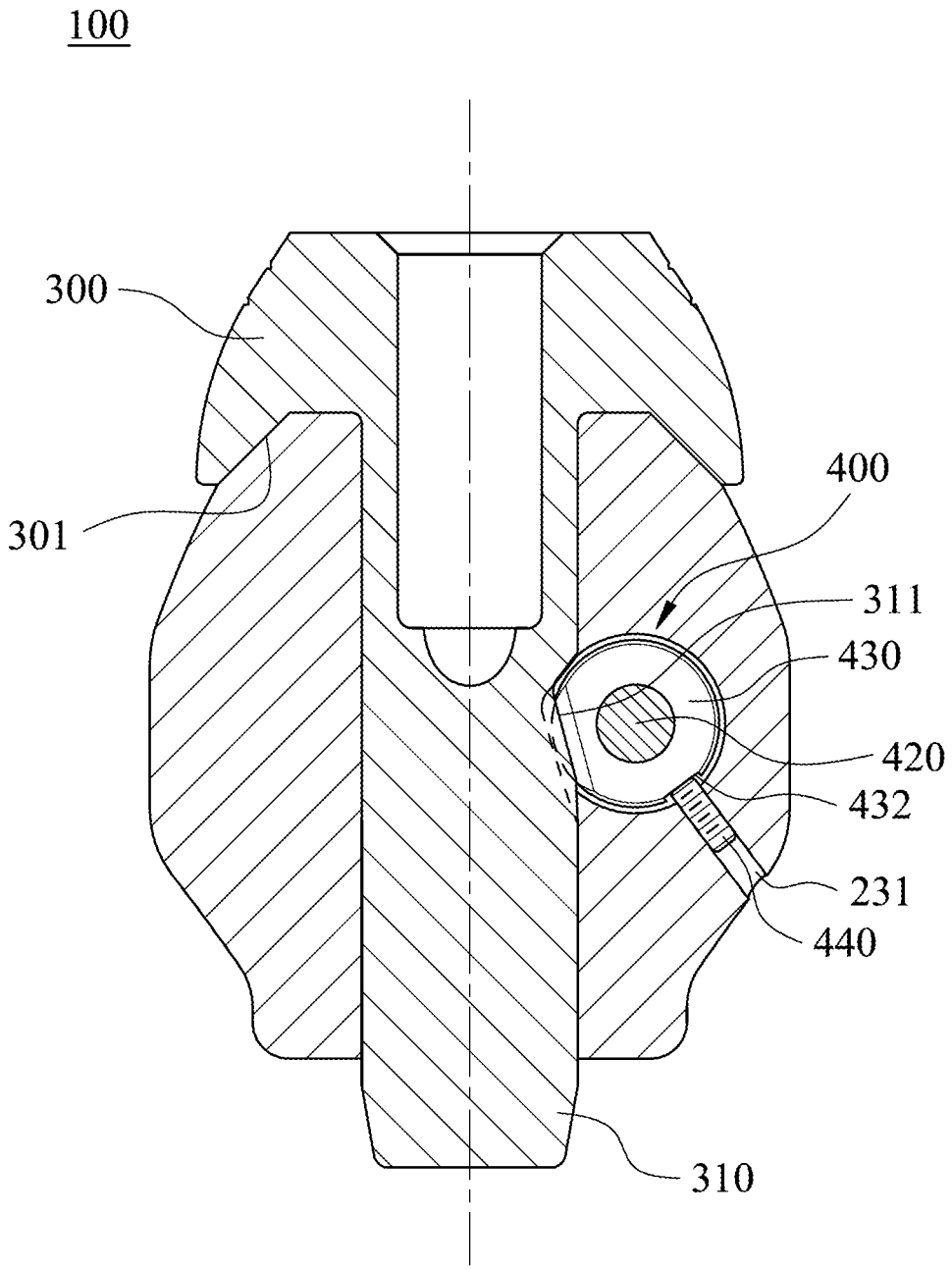
FIG. 5 shows a cross-sectional view of the cutting tool holding mechanism taken along line 5-5 of FIG. 2.

The sleeved portion 310 includes a butting portion 311. When the sleeved portion 310 is disposed inside the receiving bore 220, the butting portion 311 is located at an intersection of the receiving bore 220 and the limiting bore 230. As shown in FIGS. 4 and 5, the locking assembly 400 is disposed inside the limiting bore 230 to push against the handle 300. The locking assembly 400 includes a packing ring 410, a locking screw 420, a locking member 430, a guiding bolt 440 and two covers 450. The packing ring 410 has a through hole 411 which is configured for the locking screw 420 to pass through. The locking screw 420 includes a head portion 421 and a screwing portion 422. The head portion 421 is abutted against the packing ring 410. The screwing portion 422 is inserted the through hole 411 to protrude into the limiting hole 231. The locking member 430 is received inside the limiting bore 230 and includes a screwed hole 431 and a guiding groove 432. The screwed hole 431 is for securing the screwing portion 422. The guiding groove 432 is disposed at one side of the locking member 430, and an extension direction of the locking member 430 is parallel to a central axis of the limiting bore 230. The guiding groove 432 is aligned with limiting hole 231 when the locking member is disposed inside the limiting bore 230, and the guiding bolt 440 is disposed inside the limiting hole 231.

To be more specific, the head portion 421 of the locking screw 420 is limited at one side of the packing ring 410. When the screwing portion 422 is rotated, the locking member 430 is moved along the extension direction due to the limitation of the guiding bolt 440. The locking member 430 will be moved toward the head portion 421 along the central axis when the locking screw 420 is fastened. As shown in FIGS. 1 and 2, the limiting bore 230 runs through the base 200, and the locking assembly 400 can include two covers 450 for closing two openings of the limiting bore 230, respectively; thus, that foreign materials fall into the limiting bore 230 can be prevented.

Figure 3:
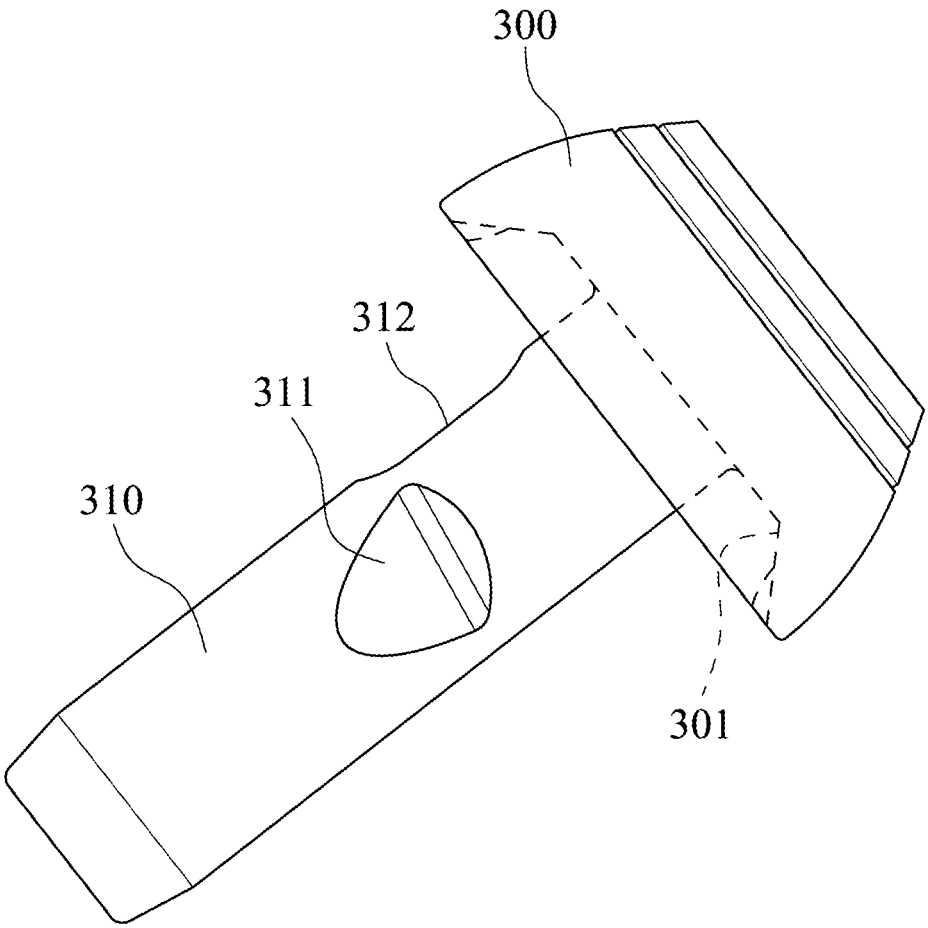
FIG. 3 shows a schematic view of a handle of FIG. 1.

FIG. 3 shows a schematic view of a handle 300 of FIG. 1. A shape of the butting portion 311 is corresponding to the moving direction of the locking member 430. That is, one side of the butting portion 311, which faces toward the locking member 430, is wide and thin. A thickness of the butting portion 311 is incrementally increased along the moving direction of the locking member 430.

FIG. 4 shows a cross-sectional view of the cutting tool holding mechanism 100 taken along line 4-4 of FIG. 2. FIG. 5 shows a cross-sectional view of the cutting tool holding mechanism 100 taken along line 5-5 of FIG. 2. When the locking screw 420 is fastened, the locking member 430 which is limited by the guiding bolt 440 is moved toward the upper left side of FIG. 4. As the thickness of the butting portion 311 becomes larger, the locking member 430 will push against the handle 300 when the locking member 430 keeps moving; thus, the handle 300 is pushed against an inner wall of the receiving bore 220 and is secured at the base 200.

In an embodiment, an angle A contained between the limiting bore 230 and a virtual horizontal-surface is smaller than 180 degrees, and the angle A is 45 degrees in this embodiment. In other words, a central line of the limiting bore 230 is not parallel to the horizontal-surface (X-Z surface) but is parallel to a virtual vertical-surface (X-Y surface). Hence, when an operator wants to change the cutting tool or repair the cutting tool holding mechanism 100, he/she can operate the locking assembly 400 easily and will not be limited by the other cutting tool holding mechanisms disposed nearby. Besides, the cutting tool holding mechanism 100 is easily checked and operated by the operator.

Figure 6:
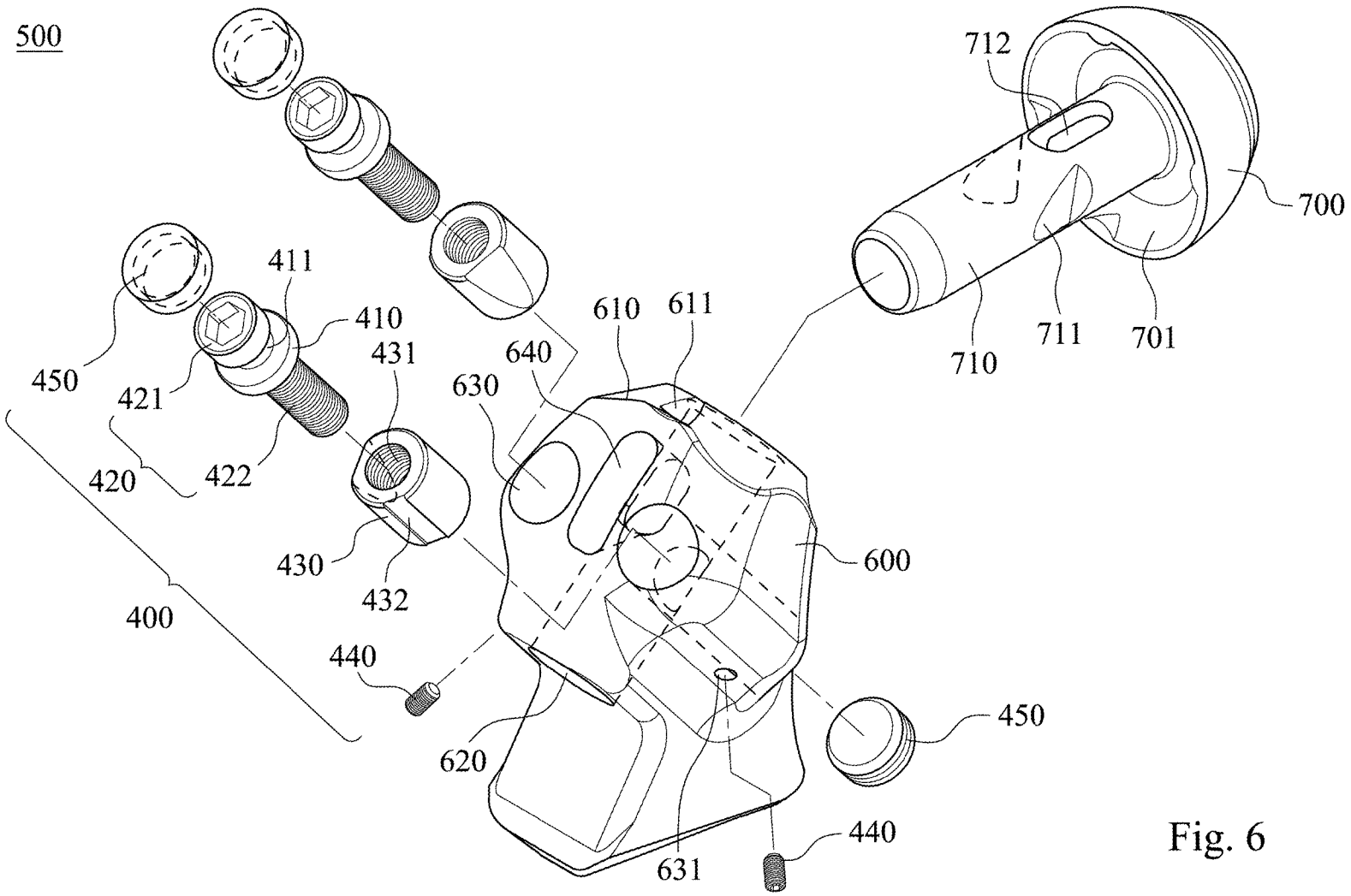
FIG. 6 shows an exploded view of a cutting tool holding mechanism according to another embodiment of the present disclosure.
Figure 7:
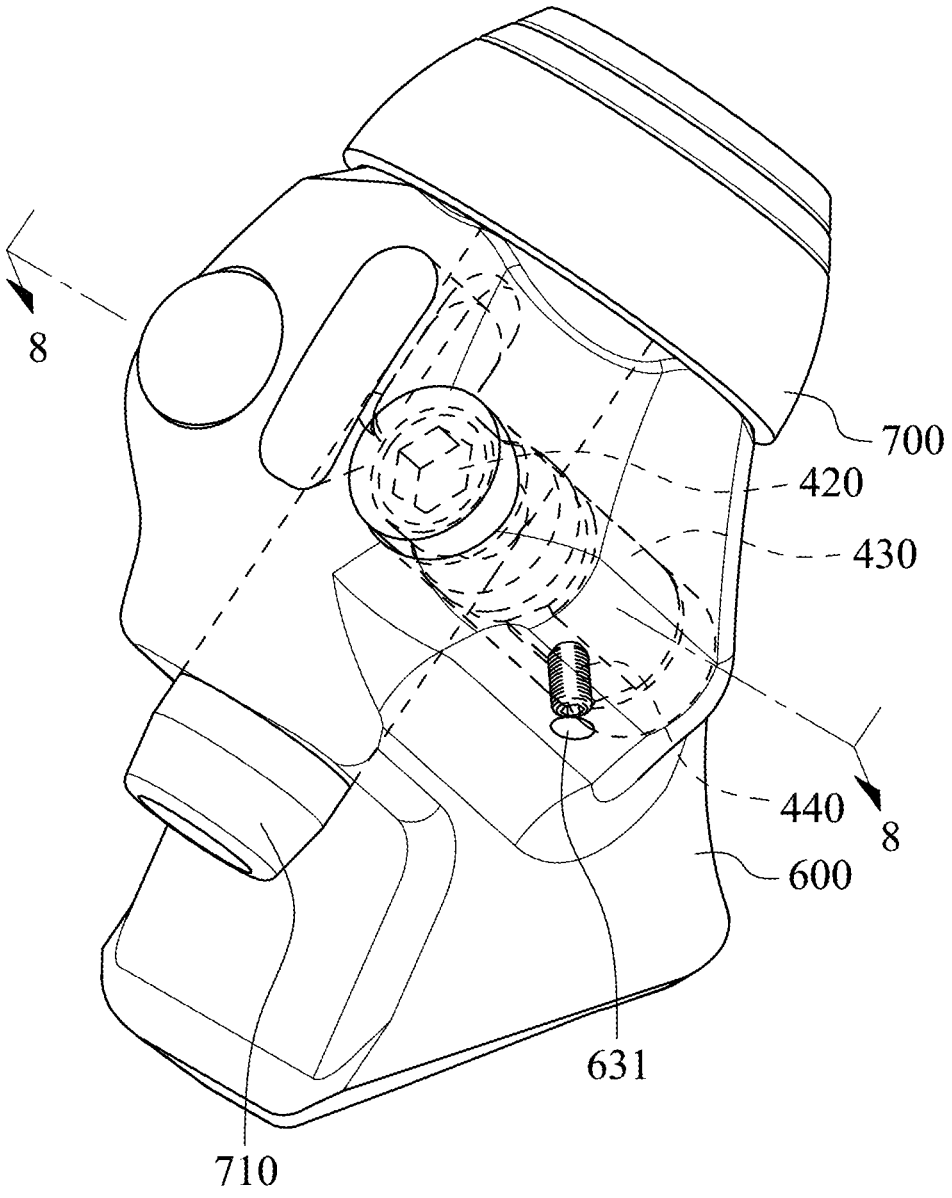
FIG. 7 shows a schematic view of a combination state of the cutting tool holding mechanism of FIG. 6.

Please refer to FIG. 6 and FIG. 7. FIG. 6 shows an exploded view of a cutting tool holding mechanism 500 according to another embodiment of the present disclosure. FIG. 7 shows a schematic view of a combination state of the cutting tool holding mechanism 500 of FIG. 6. In another embodiment of the present disclosure, the cutting tool holding mechanism 500 includes a base 600, a handle 700 and two locking assemblies 400. The base 600 includes an abutting portion 610, a receiving bore 620 and two limiting bores 630. The abutting portion 610 includes a plurality of abutting surfaces 611, and a number of the abutting surfaces 611 and a position and a shape of each of abutting surfaces 611 are not limited thereto. The receiving bore 620 depressively disposed at the base 600. The limiting bores 630 are disposed at two sides of the receiving bore 620, respectively, and are both communicated with the receiving bore 620. Two limiting holes 631 are disposed at two sides of the base 600 to correspond to two limiting bores 630, respectively.

The handle 700 is abutted against the base 600. The handle 700 includes a sleeved portion 710 and a plurality of positioning surfaces 701. The sleeved portion 710 is received inside the receiving bore 620. The number of the positioning surfaces 701 is corresponding to the number of the abutting surfaces 611, and the shapes of the positioning surfaces 701 are corresponding to the shapes of the abutting surfaces 611. Accordingly, the positioning surfaces 701 can provide positioning function to position the handle 700 on the base 600 when the sleeved portion 710 is inserted into the receiving bore 620. In the embodiment, the abutting surfaces 611 are annularly distributed at the base 600 to surround an opening of the receiving bore 620; thus, the handle 700 which is inserted into the receiving bore 620 can be auto-centering. Besides, the base 600 includes a pin hole 640, and the sleeved portion 710 includes an anchor hole 712 corresponding to the pin hole 640. When the handle 700 is abutted against the base 600, a pin (not shown) can be inserted into the pin hole 640 and the anchor hole 712 to secure the handle 700.

The sleeved portion 710 includes a butting portion 711. When the sleeved portion 710 is disposed inside the receiving bore 620, the butting portion 711 is located at an intersection of the receiving bore 620 and the limiting bore 630. As shown in FIG. 7, the locking assemblies 400 are disposed inside two limiting bores 630, respectively, to push against the handle 700. The locking assembly 400 includes a packing ring 410, a locking screw 420, a locking member 430, a guiding bolt 440 and two covers 450. The packing ring 410 has a through hole 411 which is configured for the locking screw 420 to pass through. The locking screw 420 includes a head portion 421 and a screwing portion 422. The head portion 421 is abutted against the packing ring 410. The screwing portion 422 is inserted the through hole 411 to protrude into the limiting bore 630. The locking member 430 is received inside the limiting bore 630 and includes a screwed hole 431 and a guiding groove 432. The screwed hole 431 is for securing the screwing portion 422. The guiding groove 432 is disposed at one side of the locking member 430, and an extension direction of the locking member 430 is parallel to a central axis of the limiting bore 630. The guiding groove 432 is aligned with limiting hole 631 when the locking member 430 is disposed inside the limiting bore 630, and the guiding bolt 440 is disposed inside the limiting hole 631. Covers 450 are for closing two openings of limiting bore 630 to prevent foreign materials falling into the limiting bore 630.

The operating principle and the efficient of the locking assembly 400 is disclosed in the above embodiment and will not be described again.

Figure 8:
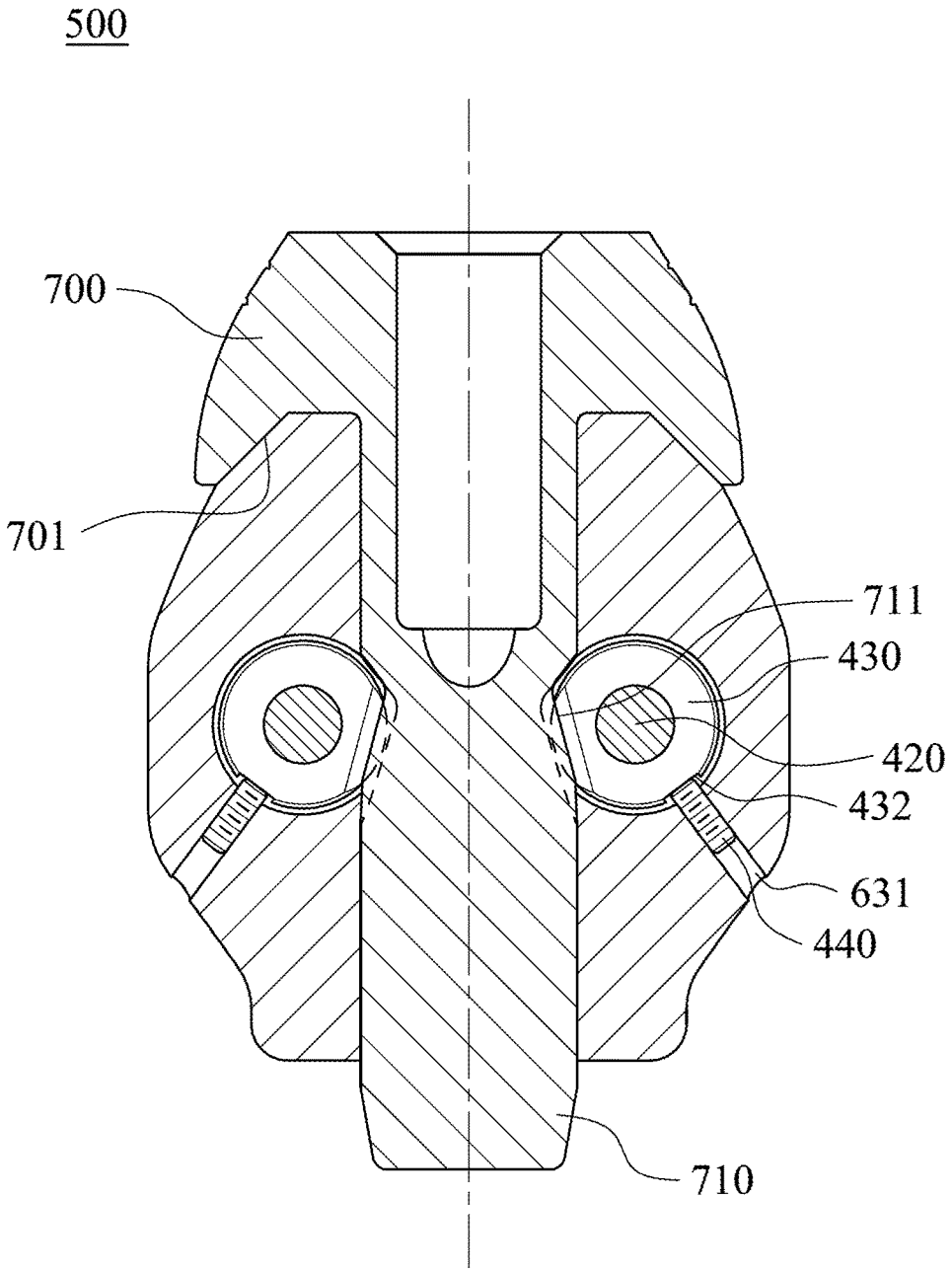
FIG. 8 shows a cross-sectional view of the cutting tool holding mechanism taken along line 8-8 of FIG. 7.

Please refer to FIG. 4 and FIG. 8. FIG. 8 shows a cross-sectional view of the cutting tool holding mechanism 500 taken along line 8-8 of FIG. 7. When the locking screw 420 is fastened, the locking member 430 which is limited by the guiding bolt 440 is moved toward the upper left side of FIG. 4. As the thickness of the butting portion 711 becomes larger, the locking member 430 will push against the handle 700 when the locking member 430 keeps moving; thus, the handle 700 is push against an inner wall of the receiving bore 620 and is secured at the base 600.

And in FIG. 8, two butting portions 711 of the sleeved portion 710 are pushed by two locking members 430 from two opposite sides of the sleeved portion 710, respectively; thus, the securing load adding on the sleeved portion 710 is increased and the stress on the sleeved portion 710 is balance. Therefore, damage due to overload can be prevented.

As described in the above embodiments, the cutting tool holding mechanism has the following advantages. 1. Because the base of the cutting tool holding mechanism is a one-piece element, the mechanical strength is increased and the design of the mold is simplified. Hence, the cost is decreased and the yield is increased. 2. When the central axis of the locking assembly is parallel to the virtual vertical-surface, the operation for changing new cutting tool or repair is easier. The repairing quality can be improved. 3. The annularly distribution of the positioning surfaces can be coordinated with the abutting surfaces to position the handle such that the handle can be auto-centering when disposed inside the base. The milling ability is increasing. 4. The moving direction of the locking member is parallel to the direction along which the milling force is applied to the cutting tool. Consequently, the cutting tool will not easily be separated from the handle, and the self-securing ability of the cutting tool is better. 5. Because the central axis of the locking assembly is parallel to the virtual vertical-surface, the securing ability between the handle and the base is sufficient such that the reaction force and supporting force distributing uniformly on the surface of the handle. Besides, due to the disposition of the limiting bores, there is no necessary to separate the cutting tool holding mechanism when the fastening the handle into the base.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims.

What is claimed is:

1. A cutting tool holding mechanism, comprising:

a base, comprising:

an abutting portion comprising a plurality of abutting surfaces;

a receiving bore;

at least one limiting bore communicated with the receiving bore; and at least one limiting hole communicated with the limiting bore;

a handle, comprising:

a sleeved portion disposed inside the receiving bore, the sleeved portion comprising at least one butting portion, wherein the butting portion is located at an intersection of the receiving bore and the limiting bore when the sleeved portion is disposed inside the receiving bore, and a plurality of positioning surfaces, each of the positioning surfaces corresponding to each of the abutting surfaces; and at least one locking assembly, comprising:

a packing ring comprising a through hole;

a locking screw, comprising:

a head portion abutted against the packing ring; and a screwing portion for passing through the through hole to protrude into the limiting bore;

a locking member received inside the limiting bore, the locking member comprising:

a screwed hole for securing the screwing portion; and a guiding groove disposed at one side of the locking member, the guiding groove being aligned with the limiting hole when the locking member being disposed inside the limiting bore, an extending direction of the guiding groove being parallel to a central axis of the limiting bore; and a guiding bolt disposed in the limiting hole, the guiding bolt abutted against the guiding groove to inhibit the locking member from rotating, the locking member being moved along the central axis to push against the butting portion.

2. The cutting tool holding mechanism of claim 1, wherein the abutting surfaces are annularly distributed at the abutting portion.

3. The cutting tool holding mechanism of claim 2, wherein the receiving bore is surrounded by the abutting surfaces.

4. The cutting tool holding mechanism of claim 1, wherein an angle contained between the central axis of the limiting bore and a virtual horizontal-surface is smaller than 180 degrees.

5. The cutting tool holding mechanism of claim 1, wherein the central axis of the limiting bore is located on a virtual vertical-surface.

6. The cutting tool holding mechanism of claim 1, wherein the receiving bore passes through the base.

7. The cutting tool holding mechanism of claim 1, wherein the limiting bore passes through the base.

8. The cutting tool holding mechanism of claim 7, wherein the locking assembly further comprises:

two covers disposed at two sides of the limiting bore, respectively, such that the limiting bore is closed.

9. The cutting tool holding mechanism of claim 1, wherein the base comprises a pin hole, the sleeved portion comprises an anchor hole which is corresponding to the pin hole, and the pin hole and the anchor hole are configured to allow a pin to insert so as to secure the handle.

10. The cutting tool holding mechanism of claim 1, wherein a number of the limiting bores is two, a number of the limiting holes is two, a number of the butting portions is two, the two limiting bores and the two limiting holes are disposed at two corresponding sides of the receiving bore, respectively, and the two butting portions are disposed at two corresponding sides of the sleeved portion, respectively.

11. The cutting tool holding mechanism of claim 10, wherein a number of the locking assemblies is two, and the two locking assemblies are corresponding to the two limiting bores, respectively.

12. A cutting tool holding mechanism, comprising:

a base, comprising:

a receiving bore;

at least one limiting bore communicated with the receiving bore, an angle contained between a central axis of the limiting bore and a virtual horizontal-surface being smaller than 180 degrees; and at least one limiting hole communicated with the limiting bore, a handle, comprising:

a sleeved portion disposed inside the receiving bore, the sleeved portion comprising at least one butting portion, wherein the butting portion is located at an intersection of the receiving bore and the limiting bore when the sleeved portion is disposed inside the receiving bore, and at least one locking assembly, comprising:

a locking screw, comprising:

a head portion; and a screwing portion for protruding into the limiting bore;

a locking member received inside the limiting bore, the locking member comprising:

a screwed hole for securing the screwing portion; and a guiding groove disposed at one side of the locking member, the guiding groove being aligned with the limiting hole when the locking member being disposed inside the limiting bore, an extending direction of the guiding groove being parallel to the central axis of the limiting bore; and a guiding bolt disposed in the limiting hole, the guiding bolt abutted against the guiding groove to inhibit the locking member from rotating, the locking member being moved along the central axis to push against the butting portion.

13. The cutting tool holding mechanism of claim 12, wherein the limiting bore is parallel to a virtual vertical-surface.

14. The cutting tool holding mechanism of claim 12, wherein the receiving bore passes through the base.

15. The cutting tool holding mechanism of claim 12, wherein the limiting bore passes through the base.

16. The cutting tool holding mechanism of claim 15, wherein the locking assembly further comprises:

two covers disposed at two sides of the limiting bore, respectively, such that the limiting bore is closed.

17. The cutting tool holding mechanism of claim 12, wherein the base comprises a pin hole, the sleeved portion comprises an anchor hole which is corresponding to the pin hole, and the pin hole and the anchor hole are configured to allow a pin to insert so as to secure the handle.

18. The cutting tool holding mechanism of claim 12, wherein a number of the limiting bores is two, a number of the limiting holes is two, a number of the butting portions is two, the two limiting bores and the two limiting holes are disposed at two corresponding sides of the receiving bore, respectively, and the two butting portions are disposed at two corresponding sides of the sleeved portion, respectively.

19. The cutting tool holding mechanism of claim 18, wherein a number of the locking assemblies is two, and the two locking assemblies are corresponding to the two limiting bores, respectively.

* * * * *